US005413133A

United States Patent [19]

Russell

[11] Patent Number: 5,413,133

[45] Date of Patent: May 9, 1995

[54] PAINT ROLLER CLEANING DEVICE

[75] Inventor: Frank A. Russell, 2784W 1600N, Clinton, Utah 84015

[73] Assignees: Uniterra International Corp., Taipei, Taiwan, Prov. of China; Frank A. Russell, Clinton, Utah ; a part interest

[21] Appl. No.: 207,177

[22] Filed: Mar. 8, 1994

[51] Int. Cl.[6] ..... B08B 3/02

[52] U.S. Cl. ..... 134/138; 134/900

[58] Field of Search ..... 134/900, 138

[56] References Cited

U.S. PATENT DOCUMENTS

| | | | |
|---|---|---|---|
| 2,831,488 | 4/1958 | Anderson | 134/900 X |
| 3,688,785 | 9/1972 | Stevens et al. | 134/900 X |
| 3,886,960 | 6/1975 | Krueger | 134/138 |
| 4,130,124 | 12/1978 | Sherwin | 134/900 X |
| 4,672,987 | 6/1987 | Brandt | 134/900 X |
| 4,735,221 | 4/1988 | Vegiard | 134/900 X |

FOREIGN PATENT DOCUMENTS

| | | | |
|---|---|---|---|
| 2360884 | 6/1975 | Germany | 134/900 |
| 2716931 | 10/1978 | Germany | 134/900 |
| 2949554 | 6/1981 | Germany | 134/900 |

*Primary Examiner*—Philip R. Coe

*Attorney, Agent, or Firm*—Jacobson, Price, Holman & Stern

[57] ABSTRACT

A paint roller cleaning device includes a housing covered with a cover to hold the cylindrical brush of the paint roller on the inside, a spray tube received inside the housing and controlled to eject water onto the cylindrical brush of the paint roller causing the cylindrical brush washed or causing it turned to shake off water.

4 Claims, 3 Drawing Sheets

PAINT ROLLER CLEANING DEVICE

BACKGROUND OF THE INVENTION

The present invention relates to an apparatus for cleaning paint roller. The device comprises a housing, which receives the paint roller to be cleaned in place, a spray tube disposed inside the housing, through which water is ejected onto the cylindrical brush of the paint roller causing it to rotate, and therefore the cylindrical brush of the paint roller is cleaned.

Paint rollers are widely used for applying paint or glue to the wall because they can put paint or glue on the wall evenly and rapidly. However, after each application, the paint roller must be washed quickly before the residual glue or paint is hardened. A paint roller user may wash the paint roller with running water while washing the user's hands may be contaminated by the residual paint or glue and therefore the user's hands must be washed after the paint roller has been cleaned. Furthermore, after the paint roller has been washed, the cylindrical brush must be wiped up or dried. It is not conveniently to wipe the cylindrical brush of the paint roller with a cloth.

SUMMARY OF THE INVENTION

The present invention eliminates the aforesaid problems. It is therefore the main object of the present invention to provide a paint roller cleaning device which effectively cleans the paint roller to be washed without contaminating the operator's hands.

According to one aspect of the present invention, the paint roller cleaning device comprises a housing covered with a cover to hold the cylindrical brush of the paint roller to be washed on the inside, a spray tube connected between two opposite ends of the housing on the inside by a retainer ring and a hose connector and having a series of jet nozzles for the ejection of water onto the cylindrical brush of the paint roller. According to another aspect of the present invention, the hose connector is turnably inserted into a hole on the housing and fixed in position by a tightening up screw for connecting a hose from a water supply outlet, wherein the hose connector can be turned to change the angular position of the spray tube to let water be perpendicularly ejected onto the cylindrical brush of the paint roller causing it be cleaned, or to let rarer touch the periphery of the cylindrical brush at one point without cutting, causing the cylindrical brush to rotate and to shake off water.

DETAILED DESCRIPTION OF THE PREFERRED EMBODIMENT

Figure 1:
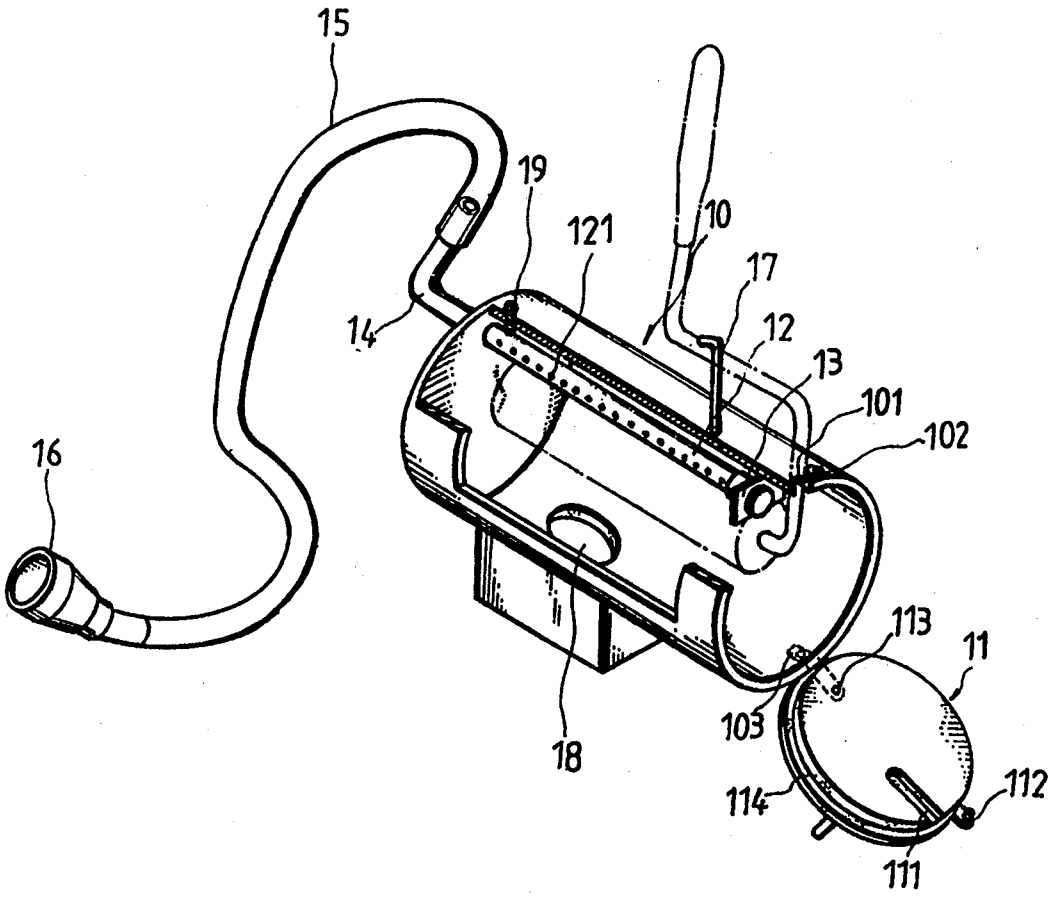
FIG. 1 is a cutaway view of a paint roller cleaning device according to the preferred embodiment of the present invention.
Figure 2:
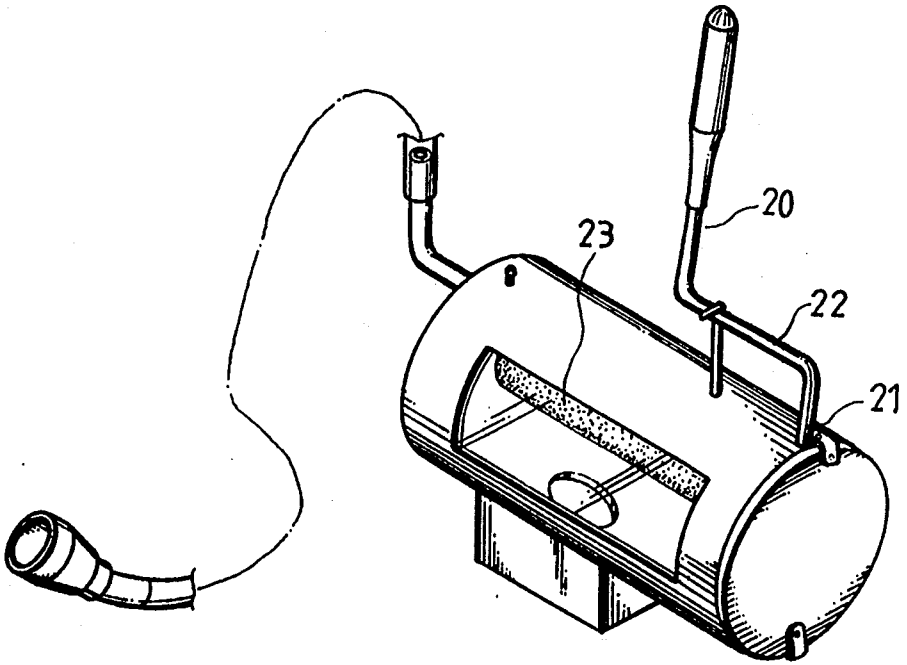
FIG. 2 is an elevational view of the paint roller cleaning device shown in FIG. 1.

Referring to FIGS. 1 and 2, a paint roller cleaning device in accordance with the preferred embodiment of the present invention is generally comprised of a housing 10, a cover 11, a spray tube 12, and a hose 15.

The housing 10 is a substantially enclosed container having one end open. A strap 103 is affixed to the housing 10 at the bottom near the opening thereof. The strap 103 has an opposite end fastened to a fastener 113 on the inside wall of the cover 11. Therefore, the cover 11 is connected to the housing 10. The cover 11 comprises an inside flange 114 fitted into the casing 10 at one end to seal the opening of the housing 10, a fastening strap 112 on the outside wall opposite to the strap fastener 113 for fastening to a strap fastener 102 on the housing 10 at the top, an elongated groove 111 on the inside wall thereof, through which the vertical handle section 21 of the paint roller 20 passes. The housing 10 further comprises a strap fastener 102 at the top, to which the fastening strap 112 of the cover 11 is fastened, and a notch 101 on one end thereof at the top, through which the vertical handle section 21 of the paint roller 20 passes. The spray tube 12 is disposed inside the housing 10, having one end fastened to a retainer ring 13 suspended from the inside wall of the housing 10, and an opposite end connected to a hose connector 14. The hose connector 14 is revolvably inserted in a hole (not shown) on the housing 10 at the end opposite to the cover 11, and fixed in position by a tightening up screw 19. The spray tube 12 comprises a series of jet nozzles 121 spaced along the length. The hose 15 has one end connected to the hose connector 14 and an opposite end coupled with a pipe connector 16 for connecting to a water supply outlet. There is a drain hole 18 made on the housing 10 at the bottom for carrying off water, and a retainer rod 17 raised from the housing 10 at the top for holding down the horizontal handle section 22 of the handle of the paint roller 20.

Figure 3:
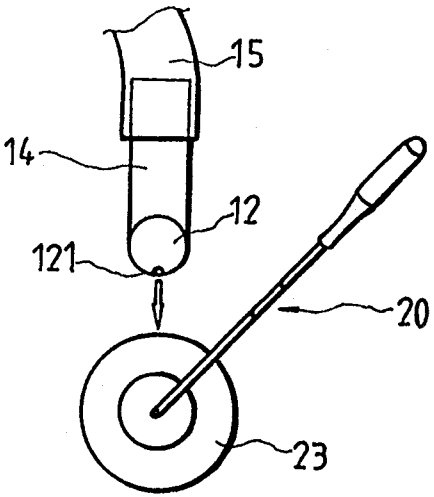
FIG. 3 is a schematic drawing showing water ejected perpendicularly onto the cylindrical brush of the paint roller.

Referring to FIG. 3, the hose connector 14 is turned to change the angular position of the spray tube 12 permitting the jet nozzles 121 of the spray tube 12 to be disposed perpendicular to the longitudinal axis of the cylindrical brush 23 of the paint roller 20, and then water is guided into the hose 15 and sent out of the spray tube 12 through the jet nozzles 121 to wash the cylindrical brush 23 of the paint roller 20.

Figure 4:
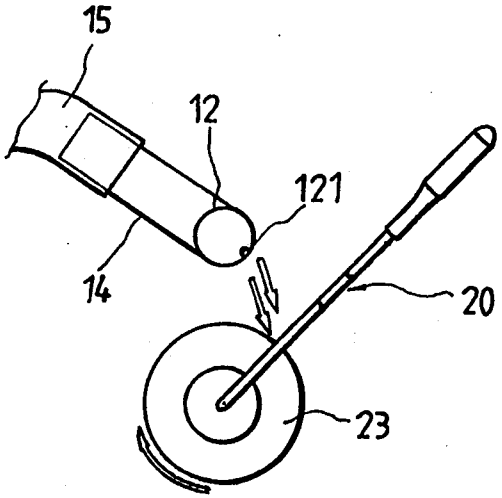
FIG. 4 is a schematic drawing showing the ejection of water touching the cylindrical brush of the paint roller at a point without cutting.

Referring to FIG. 4, the spray tube 12 can be adjusted to such an angular position that the ejection of water from the jet nozzles 121 passes over the periphery of the cylindrical brush 23 causing the cylindrical brush 23 to rotate and to shake off water.

Therefore, by means of the application of the present invention, the user can well clean the paint roller 20 without contaminating the operator's hands.

While only one embodiment of the present invention has been shown and described, it will be understood that various modifications and changes could be made without departing from the spirit and scope of the invention.

What is claimed is:

1. A paint roller cleaning device comprising:

a housing for receiving a cylindrical brush of the paint roller, said housing having an opening for inserting the brush and a cover for said opening; and a spray tube disposed inside said housing and having a longitudinal axis, said spray tube having a series of jet nozzles spaced along its length; and said spray tube being rotatably mounted about said axis in a wall of the housing and having a handle portion extending outwardly from said wall to rotate the spray tube whereby said spray tube can be turned to let water from said jet nozzles be perpendicularly ejected onto the cylindrical brush of the paint roller causing it to be cleaned, or let water from said jet nozzles touch the cylindrical brush of the paint roller causing the brush to rotate and to shake off water wherein said housing comprises an elongated groove on an inside wall of said cover, through which the handle of the paint roller passes, a notch on said housing at one end, through which the handle of the paint roller passes, a retainer rod raised from said housing on the outside for holding down the handle of the paint roller.

2. A paint roller cleaning device as claimed in claim 1 wherein one end of said spray tube is connected in said housing to a retainer ring.

3. The paint roller cleaning device of claim 1, wherein said handle portion of the spray tube terminate in a cranked hose connection.

4. A paint roller cleaning device as claimed in claim 1 wherein the housing includes a screw for releasably engaging against the spray tube to hold the spray tube in a rotatably adjusted position.

* * * * *